US006849140B2

(12) United States Patent
Thiesen et al.

(10) Patent No.: US 6,849,140 B2
(45) Date of Patent: Feb. 1, 2005

(54) INCENDIARY COMPOSITION FOR A FIN-STABILIZED KINETIC ENERGY PROJECTILE

(75) Inventors: Stefan Thiesen, Willich (DE); Hendrik Lips, Düsseldorf (DE); Lutz Börngen, Uelzen (DE); Dieter Jungbluth, Herschbach (DE)

(73) Assignee: Rheinmetall W & M GmbH, Unterluess (DE)

( * ) Notice: Subject to any disclaimer, the term of this patent is extended or adjusted under 35 U.S.C. 154(b) by 0 days.

(21) Appl. No.: 10/222,872

(22) Filed: Aug. 19, 2002

(65) Prior Publication Data

US 2003/0034102 A1 Feb. 20, 2003

(30) Foreign Application Priority Data

Aug. 18, 2001 (DE) ..... 101 40 600

(51) Int. Cl.[7] ..... C06B 45/10
(52) U.S. Cl. ..... 149/19.5; 149/19.6
(58) Field of Search ..... 149/19.5, 19.6

(56) References Cited

U.S. PATENT DOCUMENTS

| | | | | |
|---|---|---|---|---|
| 3,865,035 A | | 2/1975 | Munson et al. | |
| 3,927,993 A | * | 12/1975 | Griffin | 264/3.1 |
| 4,131,498 A | * | 12/1978 | Lucy | 149/114 |
| 4,374,760 A | * | 2/1983 | Charles | 252/519.21 |
| 4,381,692 A | | 5/1983 | Weintrub | |
| 4,402,705 A | * | 9/1983 | Daume et al. | 149/19.91 |
| 4,978,400 A | * | 12/1990 | Juneau et al. | 149/22 |
| 5,076,169 A | | 12/1991 | Jeanquartier et al. | |
| 5,780,765 A | * | 7/1998 | Dyben | 102/355 |
| 6,324,981 B1 | * | 12/2001 | Siegler et al. | 102/336 |
| 6,354,222 B1 | * | 3/2002 | Becker et al. | 102/513 |
| 6,402,864 B1 | * | 6/2002 | Gill et al. | 149/22 |
| 6,409,854 B1 | * | 6/2002 | Gill et al. | 149/22 |

FOREIGN PATENT DOCUMENTS

| | | |
|---|---|---|
| DE | 29 01 517 A1 | 8/1979 |
| DE | 199 48 708 A1 | 4/2001 |
| DE | 199 48 710 A1 | 4/2001 |
| FR | 2664039 | 1/1992 |

* cited by examiner

*Primary Examiner*—Aileen Felton
(74) *Attorney, Agent, or Firm*—Marina V. Schneller; Venable LLP

(57) ABSTRACT

An incendiary composition (14) for a fin-stabilized kinetic energy projectile (1), which can be arranged in the tail region of the projectile (1) and, upon impact with a target (13), penetrates the target (13) as a separate unit behind the penetrator (2) of the kinetic energy projectile (1). To reach the objective of a high destructive effect caused by the incendiary composition (14) within a target (13), despite a small volume and a low mass, and to ensure that the incendiary composition is ignited securely by the shock waves generated upon impact, according to the invention, a titanium sponge is used as the incendiary composition (14), with an epoxide resin or a polyester resin used as a binder.

13 Claims, 1 Drawing Sheet

INCENDIARY COMPOSITION FOR A FIN-STABILIZED KINETIC ENERGY PROJECTILE

CROSS-REFERENCE TO RELATED APPLICATION

This application is based on and claims the priority date of German Application No. 101 40 600.2, filed on Aug. 18, 2001, which is incorporated herein by reference.

BACKGROUND OF THE INVENTION

The invention relates to an incendiary composition for a fin-stabilized kinetic energy projectile, which can be installed in the tail region of the projectile and, upon impact with the target, penetrates the target as a separate unit behind the penetrator of the kinetic energy projectile.

Fin-stabilized kinetic energy projectiles with incendiary compositions arranged in the tail region of the projectile are described, for example, in German Patent Applications DE 199 48 708.1 and DE 199 48 710.3. With kinetic energy projectiles of this type, the tracer set normally used is replaced with the incendiary composition to achieve that the kinetic energy projectile developing a considerable incendiary effect when hitting semi-hard targets (e.g., armored personnel carriers with relatively thin armor). Without such an incendiary composition, the penetrator of the kinetic energy projectile would simply fly through the semi-hard target, essentially without causing any destruction, and would create a hole matching the maximum projectile diameter in the armor.

To be sure, reference DE 199 48 710.3 already discloses that the incendiary composition arranged in the tail section of the kinetic energy projectile can be selected such that it will be initiated by the shock wave generated during the impact with a corresponding target. However, this reference does not offer further details concerning the concrete design of such an incendiary composition.

Incendiary compositions consisting of a metal sponge and an organic binder are known from reference DE-AS 29 01 517, wherein it is preferable if a metal sponge consisting of zirconium or hafnium and a binder of poly tetrafluoroethylene are used. Experiments conducted by the applicant have shown that these known incendiary compositions cannot be initiated optimally by shock waves, in particular if only relatively small amounts of the respective incendiary composition are used, as is the case with incendiary compositions for kinetic energy projectiles that replace the tracer sets.

SUMMARY OF THE INVENTION

It is the object of the invention to provide incendiary compositions for fin-stabilized kinetic energy projectiles, which cause considerable destruction in a target despite having a relatively small volume and low mass and which are securely ignited by the shock waves generated upon impact with the target.

The above object generally is achieved according to the present invention in that a titanium sponge is used as the incendiary composition with epoxide resin or polyester resin used as a binder. Since the incendiary composition does not contain an oxygen carrier, it is relatively insensitive. Several advantageous embodiments are disclosed.

Upon impact with the target, the titanium sponge particles are heated to the ignition temperature and continue to burn intensively when the particles are released and come in contact with the oxygen in the air.

Experiments have shown that the relatively brittle titanium sponge because of its low ductile quality is considerably more suitable for an incendiary composition than ductile materials such as zirconium powder, magnesium powder or aluminum powder. In addition, the incendiary compositions according to the invention can also set on fire hard to ignite oils (such as diesel or hydraulic oil).

Another advantage of the incendiary compositions according to the invention is that during the normal state, they behave in the same manner as an inert material and can be ignited only with an extremely strong impact. Thus, the projectile can be handled safely even it the target is missed, provided the incendiary composition is not damaged.

The incendiary composition of a first advantageous embodiment of the invention consists of a mixture of 85 to 96 weight % titanium sponge and 4 to 15 weight % of the epoxide resin or polyester resin, and has a density between 1.7 and 2.8 g/cm$^3$.

To increase the energy content (increase in the enthalpy of combustion), it has proven advantageous if 10 to 20 weight % of boron powder are mixed into the incendiary composition, wherein the grain size of the boron powder should preferably be $\leqq 10$ $\mu$m. The incendiary composition of a second embodiment is therefore composed of a mixture of 65 to 86 weight % titanium sponge, 4 to 15 weight % of an epoxide resin or polyester resin and 10 to 20 weight % of boron powder, wherein the density of the incendiary composition is again between 1.7 and 2.8 g/cm$^3$.

To achieve a maximum incendiary effect in the crew compartment of an armored vehicle of this type, it has proven effective if the grain size range for the titanium sponge is selected such that 30% of the titanium sponge particles have a grain size larger than 450 $\mu$m and 70% have a grain size smaller than 450 $\mu$m.

Additional details and advantages of the invention follow from the text below and the exemplary embodiments explained with the aid of Figures.

DESCRIPTION OF THE PREFERRED EMBODIMENTS

Figure 1:
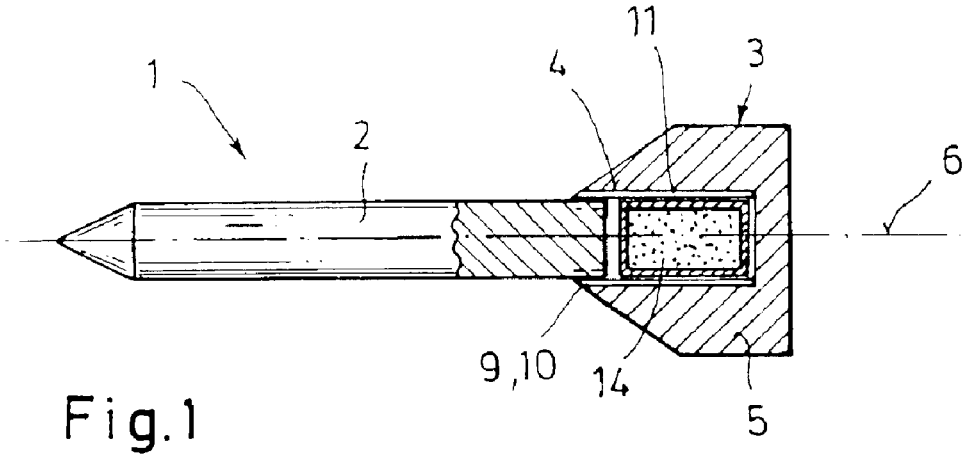
FIGS. 1 and 2 are, respectively, a longitudinal section view through a kinetic energy projective containing an incendiary composition according to the invention, before and after the impact with an armored target.

In FIG. 1, the number 1 refers to a large-caliber fin-stabilized kinetic energy projectile, for example as fired from tank cannons, The kinetic energy projectile 1 comprises a penetrator 2 and a guide assembly 3 that is attached to the rear of the penetrator 2. The guide assembly 3 essentially consists of a sleeve-type guide assembly carrier 4 with stabilizer fins 5 arranged on the outside and a recess 7 that extends in the direction of the longitudinal axis 6 of the kinetic energy projectile 1 and is closed off by this penetrator on the side or end facing the penetrator 2.

The tail region 8 of penetrator 2 extends into a front partial region 9 of the recess 7 and is non-positively connected to the guide assembly carrier 4, for example, via a threaded connection 10.

Figure 2:
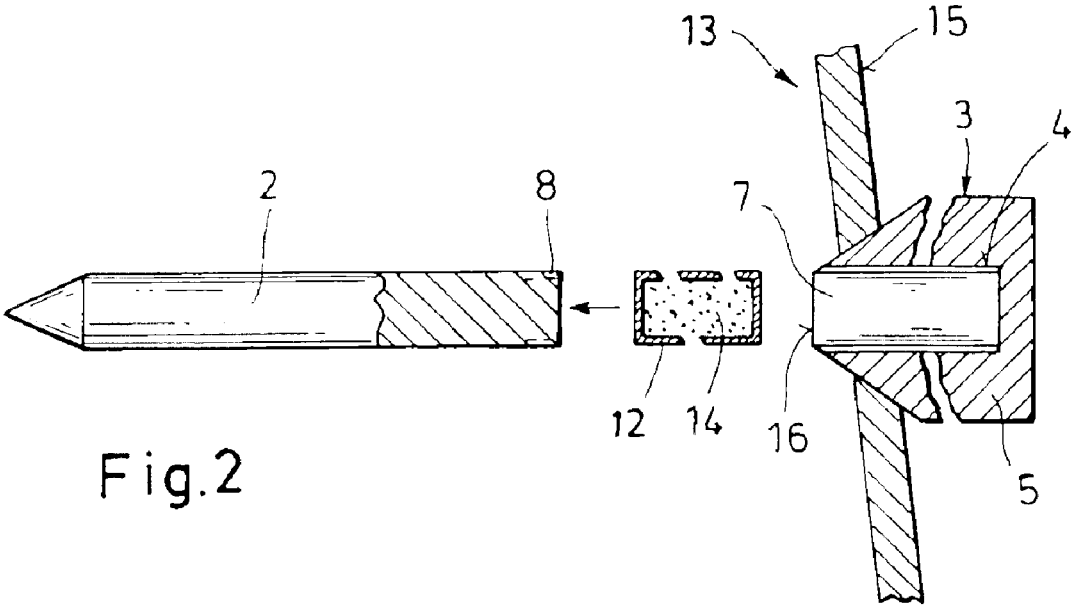

A case 12, which contains an incendiary composition 14 that is ignited only when impacting with a target 13 (e.g., a tank) (FIG. 2), is located inside a rear partial region 11 of the recess 7, which adjoins the front or forward partial region 9 on the tail side. The incendiary composition 14 is arranged inside the recess 7, such that it can be displaced in the direction of longitudinal axis 6 of the kinetic energy projectile 1 upon impact of the projectile on a target.

If the kinetic energy projectile impacts the relatively thin wall 15 of the slanted target 13 (e.g. at an angle of 60°), the penetrator 2 initially penetrates this wall 15 mostly unhindered. As soon as the guide assembly 3 hits the wall 15, it is separated from the penetrator 2 owing to its large diameter and the connected resistance and either remains in the wall 15 of target 13 or continues to fly with considerably reduced speed as compared to the penetrator 2. In the process, the stabilization fins 5 of the guide assembly 3 splinter and the case 12 of the incendiary composition 14 is torn, at least in some sections.

As a result of its mass inertia, the torn case 12 flies from the opened-up opening 16 of recess 7 in the guide assembly carrier 4 behind the penetrator 2 and is smashed, e.g., at the rear wall or on objects located inside the tank, thereby releasing the incendiary composition. The incendiary composition reacts with the oxygen in the air, so that a rain of hot sparks is sprayed far and results in considerable incendiary effect.

According to a first embodiment of the invention, the incendiary composition is comprised of 85–96 weight % titanium sponge and 4–15 weight % of an epoxide resin or a polyester resin, and the density of the incendiary composition is in the range of 1.7 to 2.8 g/cm$^3$.

According to a second embodiment of the invention, boron powder is added to the incendiary composition that is now comprised of 65–86 weight % titanium, 4–15 weight % of an epoxide resin or a polyester resin, and 10–20 weight % of boron powder, and the density of the composition is in the range of 1.7–2.8 g/cm$^3$. Preferably, the boron powder has a grain size equal to or less than 10 $\mu$m. The boron increases the combustion energy of the incendiary composition so that a correspondingly higher effect is achieved in the target because of the increased heat.

The following specific mixtures, for example, are advantageously used for the two embodiments of the incendiary compositions:

1. 96 weight e titanium sponge (grain size range: 30% larger than 450 $\mu$m; 70% smaller than 450 $\mu$m) 4 weight % epoxide resin (Araldit) mixture is compressed to a density of 2.5 g/cm$^3$.
2. 80 weight % titanium sponge (grain size range: 30% larger than 450 $\mu$m; 70% smaller than 450 $\mu$m); 5 weight % epoxide resin (Araldit) 15 weight % boron powder (grain size range: $\leqq$10 $\mu$m) mixture is compressed to a density of 2.5 g/cm$^3$.

Preferably, in both exemplary embodiments, the grain size range for the titanium powder is such that substantially 30% of the titanium sponge particles have a grain size larger than 450 $\mu$m and 70% have a smaller grain size.

While this invention has been particularly shown and described with reference to preferred embodiments thereof, it will be understood by those skilled in the art that various changes in form and details may be made therein without departing from the spirit and scope of the invention, as defined by the appended claims.

What is claimed is:

1. An incendiary composition for a fin-stabilized kinetic energy projectile, which can be arranged in the tail region of the projectile and, upon impact with a target, enters the target as a separate unit behind the penetrator of the kinetic energy projectile, said incendiary composition comprising:

85 to 96 weight % titanium sponge, and 4 to 15 weight % of an epoxide resin or a polyester resin; and wherein the density of the incendiary composition is between 1.7 and 2.8 g/cm$^3$.

2. An incendiary composition according to claim 1, wherein the incendiary composition consists essentially of 96 weight % titanium sponge and 4 weight % epoxide resin and has a density of 2.5 g/cm$^3$.

3. An incendiary composition for a fin-stabilized kinetic energy projectile, which can be arranged in the tail region of the kinetic energy projectile and, upon impact with a target, enters the target as a separate unit behind the penetrator of the kinetic energy projectile, said incendiary composition comprising:

65 to 86 weight % of titanium sponge, 4 to 15 weight % of an epoxide resin or a polyester resin, and 10 to 20 weight % of boron powder; and wherein the density of the incendiary composition is between 1.7 and 2.8 g/cm$^3$.

4. An incendiary composition according to claim 3, wherein the incendiary composition consists essentially of 80 weight % titanium sponge, 5 weight % epoxide resin and 15 weight % boron powder, and has a density of 2.5 g/cm$^3$.

5. An incendiary composition according to claim 4, wherein the boron powder has a grain size of $\leqq$10 $\mu$m.

6. An incendiary composition according to claim 3, wherein the boron powder has a grain size of $\leqq$10 $\mu$m.

7. An incendiary composition according to claim 6, wherein the grain size range for the titanium sponge is such that 30% of the titanium sponge particles have a grain size larger than 450 $\mu$m and 70% have a grain size smaller than 450 $\mu$m.

8. An incendiary composition according to claim 5, wherein the grain size range for the titanium sponge is such that 30% of the titanium sponge particles have a grain size larger than 450 $\mu$m and 70% have a grain size smaller than 450 $\mu$m.

9. An incendiary composition according to claim 4, wherein the grain size range for the titanium sponge is such that 30% of the titanium sponge particles have a grain size larger than 450 $\mu$m and 70% have a grain size smaller than 450 $\mu$m.

10. An incendiary composition according to claim 3, wherein the grain size range for the titanium sponge is such that 30% of the titanium sponge particles have a grain size larger than 450 $\mu$m and 70% have a grain size smaller than 450 $\mu$m.

11. An incendiary composition according to claim 2, wherein the grain size range for the titanium sponge is such that 30% of the titanium sponge particles have a grain size larger than 450 $\mu$m and 70% have a grain size smaller than 450 $\mu$m.

12. An incendiary composition according to claim 1, wherein the grain size range for the titanium sponge is such that 30% of the titanium sponge particles have a grain size larger than 450 $\mu$m and 70% have a grain size smaller than 450 $\mu$m.

13. An incendiary composition for a fin-stabilized kinetic energy projectile, which can be arranged in the tail region of the projectile and, upon impact with a target, enters the target as a separate unit behind the penetrator of the kinetic energy projectile, said incendiary composition comprising:

65 to 96 weight % titanium sponge, and 4 to 15 weight % of an epoxide resin or a polyester resin; and wherein the density of the incendiary composition is between 1.7 and 2.8 g/cm$^3$.

* * * * *